United States Patent [19]

Neitzel

[11] 4,208,162

[45] Jun. 17, 1980

[54] BACKHOE WEDGE LOCKING MECHANISM

[75] Inventor: Daniel R. Neitzel, Elgin, Ill.

[73] Assignee: International Harvester Company, Chicago, Ill.

[21] Appl. No.: 941,828

[22] Filed: Sep. 11, 1978

[51] Int. Cl.[2] ..... E02F 3/72; F16C 11/10

[52] U.S. Cl. ..... 414/686; 16/147; 172/272; 172/751; 280/460 A; 403/147; 403/149

[58] Field of Search ..... 414/686, 723; 280/460 R, 460 A X, 461 A; 172/272 X, 273, 274, 751 X; 403/147 X, 149 X; 16/147 X

[56] References Cited

U.S. PATENT DOCUMENTS

| | | | |
|---|---|---|---|
| 1,883,915 | 10/1932 | Holcomb | 414/723 |
| 3,705,656 | 12/1972 | Hunger | 414/723 |

*Primary Examiner*—Stephen G. Kunin
*Assistant Examiner*—George F. Abraham
*Attorney, Agent, or Firm*—Douglas W. Rudy; Ronald C. Kamp; F. David AuBuchon

[57] ABSTRACT

A backhoe frame is attached to the main frame of a host tractor vehicle at four points. A pair of upper mounting pins each pass consecutively through an outboard restraining plate in the vehicle main frame, a backhoe mounting collar integral with the backhoe frame and an inboard restraining plate. The mounting pin is a tight fit in the restraining plates and a loose fit in the backhoe mounting collar.

16 Claims, 6 Drawing Figures

BACKHOE WEDGE LOCKING MECHANISM

BACKGROUND OF THE INVENTION

1. Field of the Invention

This invention concerns a coupling device and arrangement used to couple or attach a backhoe frame to the main frame of a host tractor. More specifically, a wedge block, slidably carried between selected tractor frame members and a backhoe mounting collar of the backhoe, is urged between the backhoe mounting collar and the tractor main frame. As the wedge block is urged into position any play or looseness between the main frame and the backhoe frame is taken up such that the backhoe frame is securely mounted to the main frame and relative motion between these parts is eliminated.

2. Description of the Prior Art

Wedge locking devices have been used in a multitude of applications where it has been necessary to securely lock two components together while maintaining a certain ease of disassembly. Typical known uses of wedge locking devices include: devices for attaching tractor wheels to agricultural tractor axles, construction equipment loader hinge pin retainers and, safety frame attaching devices as well as many other applications.

Quick attach coupling arrangements are also well known in the construction equipment industry. In general these quick attach devices include parts to accomplish attachment in two stages. The first equipment requirement of a quick attach device is some type of an alignment system where the attachment may be positioned on the host vehicle in a preliminary and somewhat loose association. The second stage in attaching an implement or accessory attachment is to positively lock the attachment to the host implement. This is often accomplished through the actuation of a pin type latching bolt that may be spring loaded or hydraulically actuated into a receiving alignment aperture.

Backhoes, generally excavating scoops or shovels mounted for articulated motion to the back end of a host vehicle, have been known to be removably mounted to the host vehicle. A host vehicle may typically be a crawler tractor that may also have a front mounted loader bucket or the host vehicle may be an industrial tractor of the wheeled variety having a front mounted loader bucket. The advantages gained by providing provisions for removing the backhoe when it is not needed include increased maneuverability of the host vehicle, reduced ground pressure exerted by the host vehicle and interchangability of the backhoe between a plurality of host vehicles.

The closest prior art known to the Applicant is the current production removable backhoe manufactured by the International Harvester Company. The model designation of this removable backhoe is the 3142A Quick Attach Backhoe. This prior art backhoe mounting arrangement includes a mounting plate secured to the host vehicle. The backhoe proper includes a frame incorporating a pair of vertical cavities that are open at the end of the backhoe frame that faces the mounting plate carried by the host vehicle. A pair of stationary pins traverse the lower sections of the vertical cavities, while a pair of removable pins may be inserted through upper apertures in the side plates that proscribe boundaries of the vertical cavities.

The mounting plate, which is attached to the host vehicle's frame, also includes a projecting pair of vertically disposed carrier members each having hook-like projections on the bottom section of the carrier members and apertures on the top section of the carrier members.

The backhoe is mounted to the host vehicle when the bottom hooks cradle the stationary pins in the lower sections of the vertical cavities of the backhoe frame and the removable pins are inserted through the apertures at the top of the carrier members and the respective upper apertures in the side plates of the vertical cavities.

Once the top pins are inserted the backhoe is secure to the host vehicle. However, due to necessary tolerances between the upper pins and the pin receiving holes, the backhoe may be slightly movable relative to the host vehicle. As the pins and the accommodating apertures wear the "tightness" between the backhoe and the host vehicle will deteriorate. This imprecise fit may not affect the operation of the backhoe but it is less than optimal and may impose unnecessary stresses on the backhoe frame or the host vehicle frame.

Another disadvantage of prior art backhoe mounting arrangements is that when the assembly is new it may be difficult to insert or remove the upper mounting pins due to the relatively close tolerances between the pins and receiving apertures. Of course as these parts wear and become deformed ease of assembly may improve unless the pins are deformed which may cause disassembly difficulties.

SUMMARY OF THE INVENTION

The invention presented herein is a device for securely locking a backhoe to a host vehicle. The backhoe is supported on a frame and the host vehicle incorporates attachment fixtures that accommodate mating parts mounted to the backhoe frame.

This backhoe mounting arrangement has a four pin mounting arrangement with an upper and a lower pin on each side, left and right, of the backhoe frame. Each side of the backhoe frame has spaced apart plates that will straddle rearwardly projecting appendages or lower mounting tabs integral with the lower sections of the host vehicle frame. Pin receiving holes are provided through the lower of each set of backhoe frame plates and the rearwardly projecting appendages, these holes accommodate the two lower mounting pins.

Toward the top of each pair of side plates a backhoe mounting collar is provided. This collar passes through the paired side plates and provides an aperture for accommodating the upper mounting pins. Significantly the backhoe mounting collar has a surface formed on its outer periphery, this surface being a relatively flat bearing surface that would typically be machined on the collar. A wedge bearing plate is affixed to the back end of the host vehicle's frame and accommodates apertured restraining plates for accommodating the left and right upper mounting pins.

A wedge may be drawn up between each wedge bearing plate and the bearing surface of each backhoe mounting collar to remove any play between the backhoe frame and the host vehicle frame.

Among the advantages of this backhoe attaching mechanism is that it provides a simple and economical means of rigidly locking the backhoe to the host vehicle's frame and also can "take up" accumulative positional error associated with manufactured parts and assembly weldments.

Ease of readjustment of the system's wedges is provided as the standard hex headed adjusting bolts are accessible from both sides of the frame as well as from the inside of the operator's compartment.

The configuration set forth also provides for minimal static and dynamic loading transfers to the wedge retaining bolt since most loading is transferred through the mechanism.

Another advantage of the wedge action at the top pin mounting locations is that a large amount of tensile force can be applied to the mounting pin. The wedge will also automatically take up wear tolerances because bolt preload will force the wedge into wear clearances. Alternatively a spring assisted wedge retainer can be utilized such that the wedge is continually urged into a locking position regardless of bolt preload.

These and other advantages of this embodiment will be clear from the following description of several alternative embodiments.

IN THE DRAWING FIGURES

DETAILED DESCRIPTION OF THE INVENTION

Figure 1:
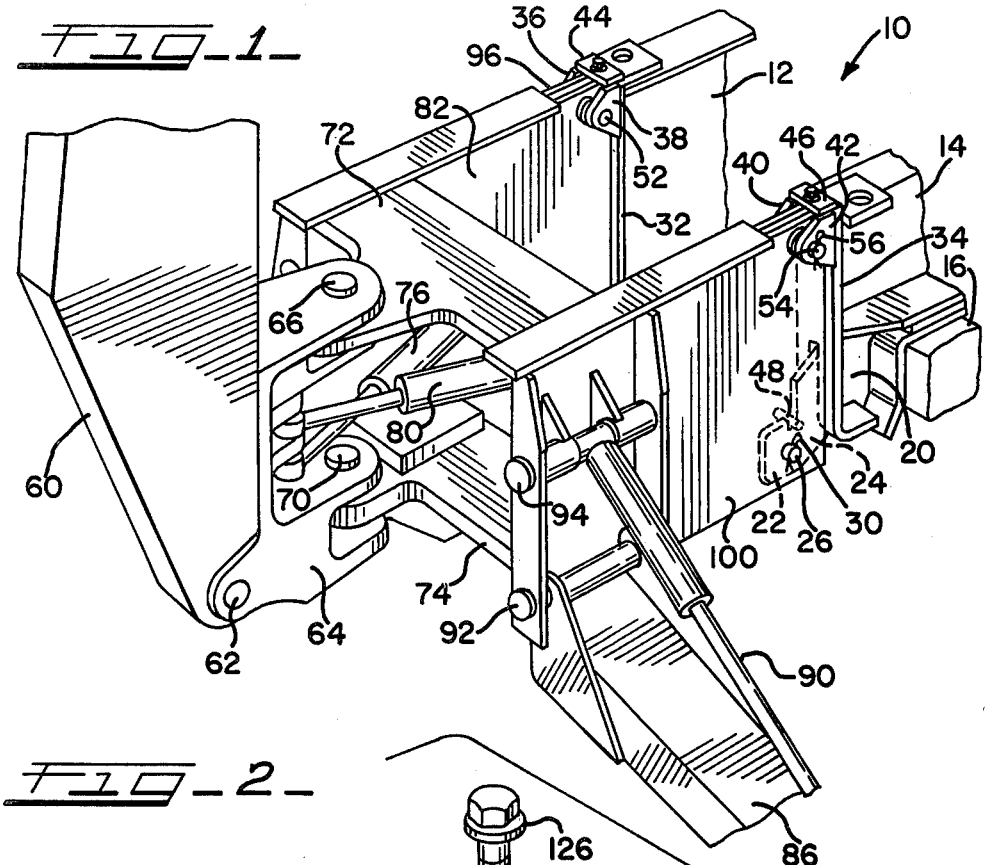
FIG. 1 is a perspective view of the attachment interface between a portion of a host vehicle frame and a portion of a backhoe and frame.

The environment of the invention can best be envisioned by looking at FIG. 1 wherein a representative portion of the host vehicle generally 10 is shown by left 12 and right 14 frame members which may be supported on an axle 16. The frame members may generally be channel section components as shown or alternatively box section or simple plate components. Critical parts of the host vehicle frame relative to this invention include lower mounting tabs, a right one 20 shown welded in a face-to-face relationship to the right side frame member 14; a wedge bearing plate assembly, including a wedge bearing plate, left and right 32 and 34 respectively, which is welded to the end of the frame rails; restraining plates 36, 38, 40 and 42; and bolt anchor plates 44 and 46. The restraining plates are provided with aligned apertures for accommodating a left 52 and a right 54 upper mounting pin, each of which may have a headed end and a nonheaded end, the nonheaded end provided with a through aperture, which, like the lower pin 26 may be retained by retainer pins such as cotter pins, hitch pins or spring pins such as 56.

An alternative mounting pin is also contemplated. This pin may be an unheaded pin having a retainer means affixed to each end thereof. The retainer could be spring pins inserted into apertures of the pin or other alternative retainers such as circlips. These are designer's choice options. The wedge bearing plate is an elongated rectangular structure having a bearing surface on the front side thereof. The bearing plate may be formed with a bent over lower portion bending away from the bearing surface or it may terminate at a lower end that is cut relatively square with respect to the longitudinal centerline of the wedge bearing plate. In this specification a wedge plate having a bent over lower portion will be considered the preferred embodiment. An elongated aperture runs longitudinally from the bent over portion part way through the length of the plate.

The lower mounting tab 20 includes a projecting portion 22 having an aperture constituting a lower mounting hole 24 for receiving the right side lower pin 26. The pin may be retained by a retaining pin passing through an aperture at its nonheaded end such as a cotter pin, hitch pin or spring pin 30. The pin may have a head at the other end.

The backhoe frame as shown in FIG. 1 is a frame that supports a backhoe 60 pivotably mounted at pin 62 to a pivoting support 64 which is pivotally supported by pins 66 and 70 to respective upper 72 and lower 74 transverse members. First and second swing cylinders 76 and 80 are pinned to the pivoting support 64 at one end thereof and to the left side inboard plate 82 and right side inboard plate 84.

Outriggers including lower and upper struts 86 and 90 may be pivotally mounted at points 92 and 94 to the backhoe frame in a conventional manner.

The longitudinal side members of the backhoe frame each are comprised of two plates, the previously mentioned inboard plates 82 and 84 and outboard side plates 96 and 100. The paired plates are separated from each other sufficiently far to accept the projecting portion 22 of the lower mounting tab 20 (both left and right sides) as can be seen in FIGS. 1 and 2.

Figure 2:
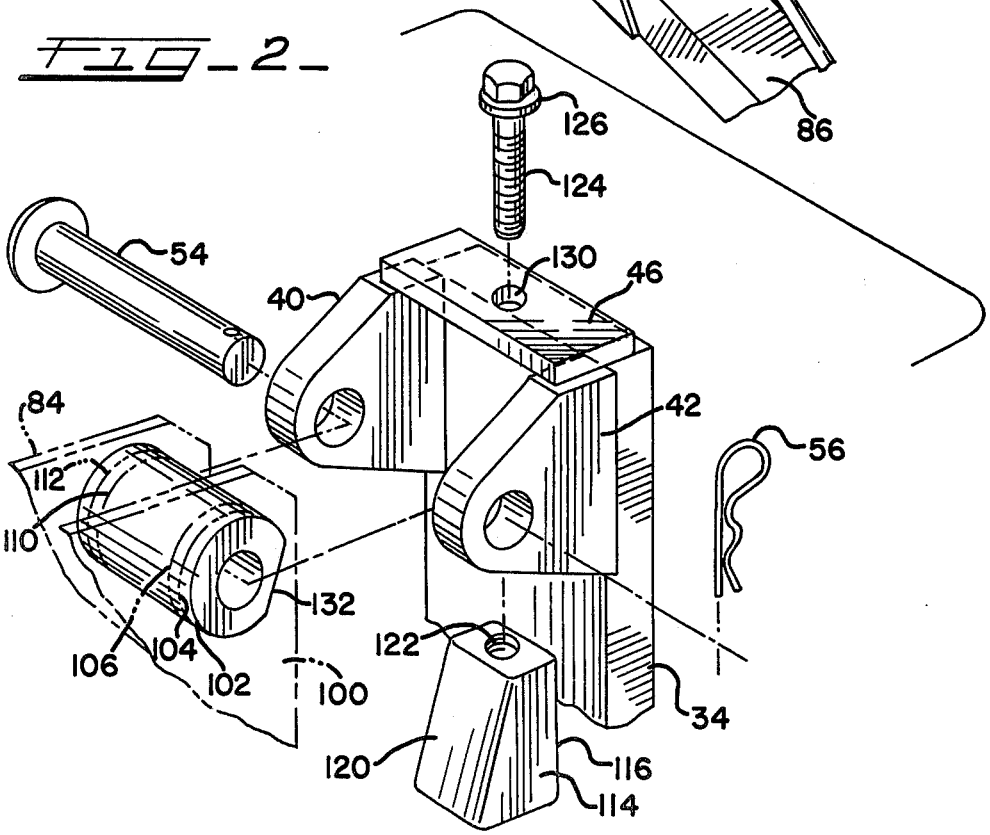
FIG. 2 is a perspective view of an upper attachment point with various components expanded away from the others.

Also shown in FIG. 2 and the subsequent figures is a backhoe mounting collar 102 which may be welded in position to the side plates at the circumferential intersections with the plates such as 104, 106, 110 and 112. The overall length of the backhoe mounting collar is substantially equal to the distance between the inboard surfaces of the restraining plates 40 and 42. A wedge 114, having a flat bearing surface 116 and inclined bearing surface 120 and a threaded aperture 122 at the truncated or upper end thereof is also shown in FIG. 2. Wedge bolt 124, equipped with a washer 126, may pass through aperture 130 in the representative bolt anchor plate 46. The inclined surface of the wedge will contact the bearing surface 132 of the backhoe mounting collar 102.

Figure 3:
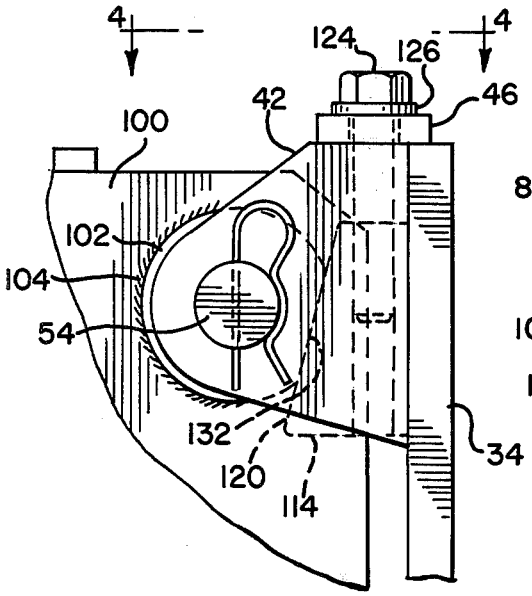
FIG. 3 is an elevation view of an upper attachment point with portions of the host vehicle's frame and the backhoe frame broken away.

FIG. 3 shows, in an elevation view, the relationship between the wedge 114 and the backhoe mounting collar 102 when the backhoe is attached to the host vehicle. The inclined bearing surface 120 of the wedge is in contact with the bearing surface 132 of the backhoe mounting collar and the flat bearing surface of the wedge is in contact with the surface of the wedge bearing plate. This has been accomplished through the tightening of the wedge bolt 124 into the threaded aperture of the wedge pulling it upward through the bolt anchor plate 46.

Figure 4:
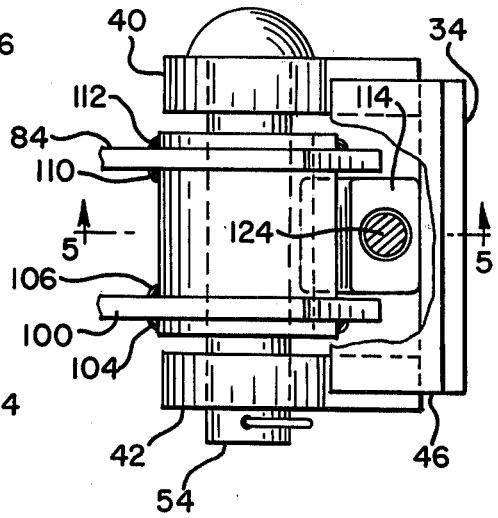
FIG. 4 is a top view of an upper attachment point with a portion broken away.

FIG. 4 is a plan view of one wedge locking unit with portions of the bolt anchor plate 46 and the wedge bolt broken away to expose the wedge 114. Restraining plates 40 and 42 are attached to the wedge bearing plate 34 and accommodate an upper mounting pin 54 through aligned apertures. Welds 104 and 112, which extend circumferentially around the juncture of the backhoe mounting collar and the outboard surfaces of plates 100 and 84, fix the collar to the side plates. Welds 106 and 110, which extend partially around the collar at the juncture of the side plates also assist in locating the collar. These welds, 106 and 110, are optional.

Figure 5:
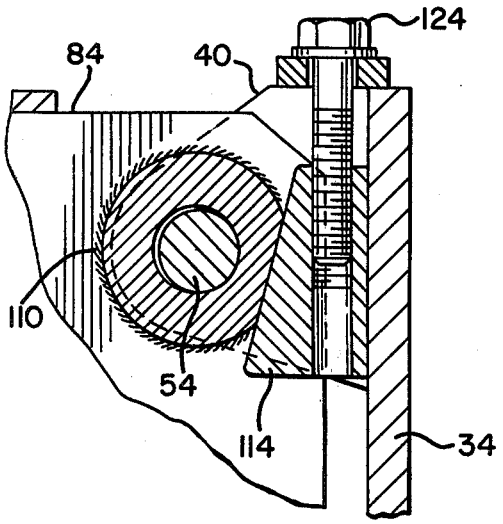
FIG. 5 is a section view of an upper attachment point taken through plane 5—5 of FIG. 4.

FIG. 5 shows the relative positions of the upper mounting pin 54 and the backhoe frame when the backhoe frame is urged away from the wedge bearing plate 34 by the wedge.

Figure 6:
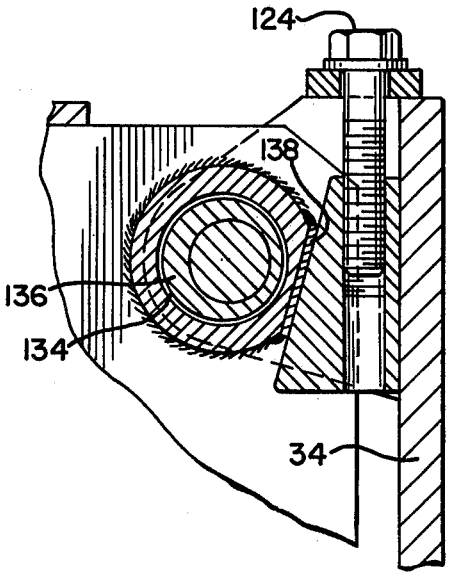
FIG. 6 is an alternative embodiment of the upper attachment point as shown in FIG. 5.

FIG. 6 shows a variation of a wedge locking system where the backhoe mounting collar has been bored out larger than the bore of the previous embodiments. This enlarged bore accommodates a bushing 136 that has an outside diameter slightly smaller than the inside diameter of the collar and has a through bore 134 formed eccentrically therethrough just slightly larger than the diameter of the pin 140. In this embodiment the pin is a snug fit unlike the first embodiment where the pin was a lose fit to accommodate machining tolerances.

Another embodiment or variation is incorporated in FIG. 6. A wear plate 138 of hardened metal has been affixed to the collar for engagement with the inclined surface of the wedge. It has been found that this wear plate would provide the necessary hard surface for interfacing with the wedge surface at a cost less than the cost of hardening the entire collar.

The wear plate 138 may also be utilized with embodiments of wedge locking devices where the collar does not accommodate the eccentric bushing 136, for instance the device of FIG. 5 could also be constructed utilizing the wear plate 138 shown in FIG. 6.

The procedure for mounting the backhoe is as follows. The backhoe has been positioned such that it is supported in a three point stance by the outriggers or stabilizers and the dipper stick (not shown). The two lower mounting pins and the two upper mounting pins have been removed from the backhoe frame. The host vehicle operator backs the host vehicle up to the backhoe frame such that the projecting portions 22 of the lower mounting tabs are inserted into the spaces between adjacent side plates such that prealignment pins attached to the inboard sides of the plates above the aligned lower apertures, one shown as 48 in FIG. 1, rest in a slightly contoured arcuately cut out portion at the top of the projecting portions 22 of the lower mounting tabs 20.

After this preliminary positioning has been accomplished the operator will connect the hydraulic control lines between the host vehicle and the backhoe vehicle. The lower pins such as 26, FIG. 1, will now be inserted through the aligned apertures in the backhoe frame side plates and the projecting portion 22 of the lower mounting tabs 20. After this has been accomplished the upper mounting pins can be inserted, typically through the restraining plate 40, backhoe mounting collar 102 and restraining plate 42. Slight adjustments are possible by moving the backhoe relative to the host vehicle's frame through extending the backhoe dipper stick.

Once all four pins have been inserted and the cotter pins, hitch pins or spring pins had been inserted through the pins to maintain them in their location the wedge locking mechanism may be adjusted. Each wedge will be drawn up tight by screwing the wedge bolt 124 into the threaded aperture 122 of the wedge thus urging the wedge upwardly while it bears against the wedge bearing plates affixed to the host vehicle frame and the machined bearing surface 132 of the backhoe mounting collar 102. This wedge will urge the backhoe mounting collar away from the wedge bearing plate such that the pin 54 will contact the relative outboard arcuate surfaces in the restraining plates, for instance 40 and 42, while the pin will contact the relative inboard arcuate surfaces of the backhoe mounting collar 102. This wedging system will securely prevent relative motion between the backhoe frame and the host frame thus ensuring positional accuracy when digging with the backhoe as well as minimizing wear on the attachment points by preventing relative motion between adjacent components.

Thus it is apparent that there has been provided a backhoe mounting arrangement utilizing a wedge locking block that performs all the objects and advantages as set forth above. Various nuances in design are contemplated by the inventor and such design variations that would be apparent to a person skilled in applicable arts are construed to be within the scope of this disclosure.

I claim:

1. Backhoe mounting apparatus for removably attaching a backhoe to a host vehicle having a longitudinally extending frame, said backhoe mounting apparatus comprising:

a wedge bearing plate assembly fixedly attached to said longitudinal frame of said host vehicle;

a lower mounting tab having a through aperture fixedly attached to said longitudinal frame of said host vehicle, said lower mounting tab passing through said wedge bearing plate;

a backhoe frame having a longitudinal member capable of being mounted to said host vehicle frame, being constructed of spaced apart side plates each provided with aligned upper and aligned lower apertures;

a backhoe mounting collar carried in said aligned upper apertures, said collar having a longitudinal bore and a flat portion;

a wedge slidably carried on said wedge bearing plate, said wedge having a flat surface for contacting said wedge bearing plate and an inclined surface for contacting said flat portion of said backhoe mounting collar;

an upper pin passing through said wedge bearing plate assembly and said longitudinal bore of said backhoe mounting collar whereby said backhoe frame is attached to said longitudinally extending frame of said host vehicle.

2. The backhoe mounting apparatus in accordance with claim 1 wherein said wedge bearing plate assembly comprises:

a wedge bearing plate being an elongated rectangular structure having a bearing surface on a front side thereof and an elongated aperture longitudinally formed part way through the length of said plate;

a pair of spaced apart restraining plates having aligned apertures affixed to the upper portion of said wedge bearing plate extending perpendicularly from said wedge bearing plate;

a bolt anchor plate having a through aperture being affixed to the wedge bearing plate above the pair of spaced apart side plates.

3. The backhoe mounting apparatus in accordance with claim 2 wherein said wedge bearing plate is an elongated rectangular structure having a bearing surface on the front side thereof and a bent over lower portion bending away from said bearing surface and an elongated aperture extending longitudinally upwardly from the bent over portion along a portion of the length of said plate.

4. The backhoe mounting apparatus in accordance with claim 1 wherein said lower mounting tab comprises an elongated tab having an apertured projecting portion extending through said wedge bearing plate assembly having an arcuately cut out portion.

5. The backhoe mounting apparatus in accordance with claim 1 wherein said backhoe frame spaced apart side plates are provided with a prealignment pin fixedly attached to the inboard sides of adjacent side plates above said aligned lower apertures.

6. The backhoe mounting apparatus in accordance with claim 1 wherein said backhoe mounting collar is welded into position by weldments at the juncture of said backhoe mounting collar and the outboard surfaces of said backhoe frame side plates.

7. The backhoe mounting apparatus in accordance with claim 1 wherein said wedge is equipped with a threaded aperture in the truncated end of the wedge.

8. The backhoe mounting apparatus in accordance with claim 7 wherein said threaded aperture of said wedge accommodates a wedge bolt further restrained by said wedge bearing plate assembly to urge said wedge between said wedge bearing plate assembly and said backhoe mounting collar when said wedge bolt is threaded into said threaded aperture of said wedge.

9. The backhoe mounting apparatus in accordance with claim 1 wherein said backhoe frame accommodates a lower pin passing through aligned lower apertures and said aperture of said lower mounting tab.

10. The backhoe mounting apparatus in accordance with claim 9 wherein said upper pin and said lower pin are provided with a headed end and a nonheaded end having a through aperture for accommodating a retention pin.

11. The backhoe mounting apparatus in accordance with claim 1 wherein said backhoe mounting collar accommodates a wear plate fastened to the machined flat surface thereof whereby said inclined surface of said wedge may contact said wear plate.

12. Backhoe mounting apparatus for removably attaching a backhoe to a host vehicle having a longitudinally extending frame, said backhoe mounting apparatus comprising:

a wedge bearing plate assembly fixedly attached to said longitudinal frame of said host vehicle, said assembly including a wedge bearing plate of rectangular structure having a bearing surface and an elongated aperture longitudinally formed part way along the length of said plate, a pair of spaced apart restraining plates having aligned apertures affixed to an upper end of said wedge bearing plate extending perpendicularly outward from said bearing surface of said plate, and a bolt anchor plate having a through aperture affixed to the upper end of said plate;

a lower mounting tab fixed to said host vehicle having an apertured projecting portion projecting through said elongated aperture of said wedge bearing plate, said projecting portion having an arcuately cut out portion;

a backhoe frame having a longitudinal member for receiving said lower mounting tab, said backhoe frame comprising spaced apart side plates provided with aligned upper and lower apertures and a prealignment pin fixedly attached to inboard surfaces of said spaced apart side plates above said aligned lower apertures;

a backhoe mounting collar carried in said aligned upper apertures of said backhoe frame, said collar having a longitudinal bore and a flat portion extending at least part way along the length of said mounting collar;

a wedge having a threaded aperture through a truncated end thereof slidably carried on said wedge bearing plate, said wedge having a flat surface for contacting said wedge bearing plate and an inclined surface for contacting said flat portion of said backhoe mounting collar;

a wedge bolt passing through said aperture of said bolt anchor plate and into said threaded aperture of said wedge to retain said wedge in contact between said wedge bearing plate and said backhoe mounting collar;

an upper mounting pin passing through one of said spaced apart restraining plates, said longitudinal bore of said backhoe mounting collar and another of said spaced apart restraining plates, said upper mounting pin having a headed end and an aperture equipped nonheaded end;

a lower mounting pin passing through one of said lower apertures of said spaced apart side plates of said backhoe frame, said aperture of said projecting portion of said lower mounting tab and another of said lower apertures of said spaced apart side plates of said backhoe frame, said lower mounting pin having a headed end and an aperture equipped nonheaded end;

a plurality of retaining pins for passing through said apertures in said nonheaded ends of said upper and said lower mounting pins.

13. The backhoe mounting apparatus in accordance with claim 12 wherein said backhoe mounting collar has an overall length substantially equal to the distance between the inboard surfaces of said spaced apart restraining plates.

14. The backhoe mounting apparatus in accordance with claim 12 wherein a wear plate may be affixed to said flat portion of said backhoe mounting collar in a portion thereof subject to being contacted by said inclined surface of said wedge.

15. The backhoe mounting apparatus in accordance with claim 12 wherein said longitudinal bore of said backhoe mounting collar accommodates an insert having an elongated bore for accommodating said upper mounting pin.

16. The backhoe mounting apparatus in accordance with claim 15 wherein said elongated bore of said insert is eccentric with respect to the outside diameter of said insert.

* * * * *